US008529232B2

(12) United States Patent
Stover et al.

(10) Patent No.: US 8,529,232 B2
(45) Date of Patent: Sep. 10, 2013

(54) COMPRESSOR HAVING CAPACITY MODULATION SYSTEM

(75) Inventors: Robert C. Stover, Versailles, OH (US); Masao Akei, Miamisburg, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 333 days.

(21) Appl. No.: 12/909,303

(22) Filed: Oct. 21, 2010

(65) Prior Publication Data

US 2011/0033328 A1 Feb. 10, 2011

Related U.S. Application Data

(63) Continuation of application No. 12/474,806, filed on May 29, 2009, now Pat. No. 8,313,318.

(60) Provisional application No. 61/057,470, filed on May 30, 2008.

(51) Int. Cl.

| | |
|---|---|
| ***F01C 1/02*** | (2006.01) |
| ***F01C 1/063*** | (2006.01) |
| ***F04C 2/02*** | (2006.01) |
| ***F04C 2/063*** | (2006.01) |
| ***F04C 18/02*** | (2006.01) |
| ***F04C 18/063*** | (2006.01) |

(52) U.S. Cl.

USPC ..... 418/55.1; 418/55.2; 418/55.5; 418/16

(58) Field of Classification Search

USPC ..... 418/55.1, 55.2, 55.4, 55.5, 55.6

See application file for complete search history.

(56) References Cited

U.S. PATENT DOCUMENTS

| | | | |
|---|---|---|---|
| 4,382,370 | A | 5/1983 | Suefuji et al. |
| 4,383,805 | A | 5/1983 | Teegarden et al. |

(Continued)

FOREIGN PATENT DOCUMENTS

| | | | |
|---|---|---|---|
| CN | 1576603 | A | 2/2005 |
| JP | 03081588 | A | 4/1991 |

(Continued)

OTHER PUBLICATIONS

International Search Report dated Janaury 14, 2010 regarding International Applicatino No. PCT/US2009/045672.

(Continued)

*Primary Examiner* — Mary A Davis

(74) *Attorney, Agent, or Firm* — Harness, Dickey & Pierce, P.L.C.

(57) ABSTRACT

A compressor includes first and second scroll members, a structure supporting the second scroll member, and a first piston. The first scroll member includes a first end plate and a first spiral wrap. The second scroll member includes a second end plate and a second spiral wrap engaged with the first spiral wrap to form compression pockets. The second end plate includes a first aperture in communication with a first compression pocket. The structure includes a first recess and first and second passages. The first piston is axially displaceable between first and second positions within the first recess. The first piston isolates the first passage from communication with the second passage when in the first and second positions, prevents communication between the first aperture and the first passage when in the first position, and provides communication between the first aperture and the first passage when in the second position.

21 Claims, 10 Drawing Sheets

(56) References Cited

U.S. PATENT DOCUMENTS

| | | | | |
|---|---|---|---|---|
| 4,431,388 | A | 2/1984 | Eber et al. | |
| 4,497,615 | A | 2/1985 | Griffith | |
| 4,669,962 | A | 6/1987 | Mizuno et al. | |
| 4,774,816 | A | 10/1988 | Uchikawa et al. | |
| 4,818,195 | A | 4/1989 | Murayama et al. | |
| 4,904,164 | A | 2/1990 | Mabe et al. | |
| 4,940,395 | A | 7/1990 | Yamamoto et al. | |
| 5,074,760 | A | 12/1991 | Hirooka et al. | |
| 5,156,539 | A * | 10/1992 | Anderson et al. | 418/55.4 |
| RE34,148 | E | 12/1992 | Terauchi et al. | |
| 5,169,294 | A | 12/1992 | Barito | |
| 5,192,195 | A | 3/1993 | Iio et al. | |
| 5,193,987 | A | 3/1993 | Iio et al. | |
| 5,240,389 | A | 8/1993 | Oikawa et al. | |
| 5,336,058 | A | 8/1994 | Yokoyama | |
| 5,356,271 | A | 10/1994 | Miura et al. | |
| 5,451,146 | A | 9/1995 | Inagaki et al. | |
| 5,551,846 | A | 9/1996 | Taylor et al. | |
| 5,557,897 | A | 9/1996 | Kranz et al. | |
| 5,562,426 | A | 10/1996 | Watanabe et al. | |
| 5,577,897 | A | 11/1996 | Inagaki et al. | |
| 5,607,288 | A | 3/1997 | Wallis et al. | |
| 5,639,225 | A | 6/1997 | Matsuda et al. | |
| 5,674,058 | A | 10/1997 | Matsuda et al. | |
| 5,678,985 | A | 10/1997 | Brooke et al. | |
| 5,855,475 | A | 1/1999 | Fujio et al. | |
| 5,885,063 | A | 3/1999 | Makino et al. | |
| 5,993,171 | A | 11/1999 | Higashiyama | |
| 5,993,177 | A | 11/1999 | Terauchi et al. | |
| 6,077,057 | A * | 6/2000 | Hugenroth et al. | 418/55.4 |
| 6,086,335 | A | 7/2000 | Bass et al. | |
| 6,102,671 | A | 8/2000 | Yamamoto et al. | |
| 6,123,517 | A | 9/2000 | Brooke et al. | |
| 6,132,179 | A | 10/2000 | Higashiyama | |
| 6,164,940 | A | 12/2000 | Terauchi et al. | |
| 6,176,686 | B1 | 1/2001 | Wallis et al. | |
| 6,210,120 | B1 | 4/2001 | Hugenroth et al. | |
| 6,213,731 | B1 | 4/2001 | Doepker et al. | |
| 6,231,316 | B1 | 5/2001 | Wakisaka et al. | |
| 6,273,691 | B1 | 8/2001 | Morimoto et al. | |
| 6,293,767 | B1 | 9/2001 | Bass | |
| 6,350,111 | B1 | 2/2002 | Perevozchikov et al. | |
| 6,412,293 | B1 | 7/2002 | Pham et al. | |
| 6,413,058 | B1 | 7/2002 | Williams et al. | |
| 6,454,551 | B2 | 9/2002 | Kuroki et al. | |
| 6,464,481 | B2 | 10/2002 | Tsubai et al. | |
| 6,506,036 | B2 | 1/2003 | Tsubai et al. | |
| 6,544,016 | B2 | 4/2003 | Gennami et al. | |
| 6,558,143 | B2 | 5/2003 | Nakajima et al. | |
| 6,589,035 | B1 | 7/2003 | Tsubono et al. | |
| 6,769,888 | B2 | 8/2004 | Tsubono et al. | |
| 6,821,092 | B1 | 11/2004 | Gehret et al. | |
| 6,881,046 | B2 | 4/2005 | Shibamoto et al. | |
| 6,884,042 | B2 | 4/2005 | Zili et al. | |
| 6,984,114 | B2 | 1/2006 | Zili et al. | |
| 7,118,358 | B2 | 10/2006 | Tsubono et al. | |
| 7,137,796 | B2 | 11/2006 | Tsubono et al. | |
| 7,229,261 | B2 | 6/2007 | Morimoto et al. | |
| 7,326,039 | B2 * | 2/2008 | Kim et al. | 418/55.5 |
| 7,344,365 | B2 | 3/2008 | Takeuchi et al. | |
| 7,354,259 | B2 | 4/2008 | Tsubono et al. | |
| RE40,344 | E * | 5/2008 | Perevozchikov et al. | 418/55.6 |
| 7,404,706 | B2 | 7/2008 | Ishikawa et al. | |
| 7,513,753 | B2 | 4/2009 | Shin et al. | |
| 7,547,202 | B2 | 6/2009 | Knapke | |
| 7,771,178 | B2 * | 8/2010 | Perevozchikov et al. | 418/55.6 |
| 7,967,582 | B2 | 6/2011 | Akei et al. | |
| 7,967,583 | B2 | 6/2011 | Stover et al. | |
| 7,972,125 | B2 | 7/2011 | Stover et al. | |
| 7,976,295 | B2 | 7/2011 | Stover et al. | |
| 7,976,296 | B2 | 7/2011 | Stover et al. | |
| 7,988,433 | B2 | 8/2011 | Akei et al. | |
| 7,988,434 | B2 | 8/2011 | Stover et al. | |
| 8,313,318 | B2 * | 11/2012 | Stover et al. | 418/55.5 |
| 2001/0010800 | A1 | 8/2001 | Kohsokabe et al. | |
| 2002/0039540 | A1 | 4/2002 | Kuroki et al. | |
| 2004/0071571 | A1 | 4/2004 | Uchida et al. | |
| 2004/0146419 | A1 | 7/2004 | Kawaguchi et al. | |
| 2004/0197204 | A1 | 10/2004 | Yamanouchi et al. | |
| 2005/0019177 | A1 | 1/2005 | Shin et al. | |
| 2005/0053507 | A1 | 3/2005 | Takeuchi et al. | |
| 2007/0092390 | A1 * | 4/2007 | Ignatiev et al. | 418/55.5 |
| 2007/0237664 | A1 | 10/2007 | Joo et al. | |
| 2008/0159892 | A1 | 7/2008 | Huang et al. | |
| 2009/0068048 | A1 | 3/2009 | Stover et al. | |
| 2009/0071183 | A1 | 3/2009 | Stover et al. | |
| 2009/0196781 | A1 | 8/2009 | Kiem et al. | |
| 2009/0297377 | A1 | 12/2009 | Stover et al. | |
| 2009/0297378 | A1 | 12/2009 | Stover et al. | |
| 2009/0297379 | A1 | 12/2009 | Stover et al. | |
| 2009/0297380 | A1 | 12/2009 | Stover et al. | |
| 2010/0111741 | A1 | 5/2010 | Chikano et al. | |
| 2010/0135836 | A1 | 6/2010 | Stover et al. | |
| 2010/0158731 | A1 | 6/2010 | Akei et al. | |
| 2010/0254841 | A1 | 10/2010 | Akei et al. | |
| 2010/0300659 | A1 | 12/2010 | Stover et al. | |
| 2010/0303659 | A1 | 12/2010 | Stover et al. | |
| 2011/0033328 | A1 | 2/2011 | Stover et al. | |
| 2011/0103988 | A1 | 5/2011 | Stover et al. | |
| 2011/0256009 | A1 | 10/2011 | Stover et al. | |

FOREIGN PATENT DOCUMENTS

| | | | |
|---|---|---|---|
| JP | 05001677 | A * | 1/1993 |
| JP | 2000161263 | A | 6/2000 |
| JP | 2007154761 | A | 6/2007 |

OTHER PUBLICATIONS

Written Opinin of the Internatinoal Searching Authority dated Janaury 14, 2010 regarding International Application No. PCT/US2009/045672.

International Search Report dated Jan. 4, 2010 regarding International Application No. PCT/US2009/045666.

International Search Report dated Jan. 21, 2010 regarding International Application No. PCT/US2009/045638.

Written Opinion of the International Searching Authority dated Jan. 21, 2010 regarding International Application No. PCT/US2009/045638, 3 pages.

International Search Report dated Jan. 8, 2010 regarding International Application No. PCT/US2009/045665.

International Search Report dated May 31, 2010 regarding International Application No. PCT/US2009/066551, 3 pgs.

Written Opinion of the International Searching Authority dated May 31, 2010 regarding International Application No. PCT/US2009/066551, 3 pgs.

International Search Report dated Jan. 14, 2010 regarding International Application No. PCT/US2009/045672.

Written Opinion of the International Searching Authority dated Jan. 14, 2010 regarding International Application No. PCT/US2009/045672.

Non-Final Office Action for U.S. Appl. No. 13/367,950, mailed Jan. 11, 2013.

Non-Final Office Action for U.S. Appl. No. 13/167,192, mailed Jan. 25, 2013.

First Office Action regarding Chinese Patent Application No. 200980126961.4, dated Feb. 5, 2013. English translation provided by Unitalen Attorneys at Law.

Written Opinion of the International Searching Authority dated Jan. 4, 2010 regarding Inernational Application No. PCT/US2009/045666.

Written Opinion of the International Search Authority dated Jan. 8, 2010 regarding International Application No. PCT/US2009/045665.

First Office Action and Search Report regarding Chinese Patent Application No. 200980126962.9, issued on Apr. 2, 2013. English translation provided by Unitalen Attorneys at Law.

* cited by examiner

COMPRESSOR HAVING CAPACITY MODULATION SYSTEM

CROSS-REFERENCE TO RELATED APPLICATIONS

This application is a continuation of U.S. patent application Ser. No. 12/474,806 filed on May 29, 2009, which claims the benefit of U.S. Provisional Application No. 61/057,470, filed on May 30, 2008. The entire disclosure of each of the above applications is incorporated herein by reference.

FIELD

The present disclosure relates to compressors, and more specifically to compressors having capacity modulation systems.

BACKGROUND

This section provides background information related to the present disclosure which is not necessarily prior art.

Scroll compressors include a variety of capacity modulation mechanisms to vary operating capacity of a compressor. The capacity modulation mechanisms may include fluid passages extending through a scroll member to selectively provide fluid communication between compression pockets and another pressure region of the compressor.

SUMMARY

This section provides a general summary of the disclosure, and is not a comprehensive disclosure of its full scope or all of its features.

A compressor may include a first scroll member, a second scroll member, a structure supporting the second scroll member for orbital movement relative to the first scroll member, and a first piston. The first scroll member may include a first end plate and a first spiral wrap extending from the first end plate. The second scroll member may include a second end plate and a second spiral wrap extending from the second end plate and engaged with the first spiral wrap to form compression pockets. The second end plate may include a first aperture extending therethrough and in communication with the first of the compression pockets. The structure may include a first recess generally aligned with the first aperture. The structure may additionally include first and second passages in communication with the first recess. The first piston may be located within the first recess and may be axially displaceable between first and second positions. The first piston may isolate the first passage from communication with the second passage when in the first and second positions. The first piston may prevent communication between the first aperture and the first passage when in the first position. The first piston may provide communication between the first aperture and the first passage when in the second position.

The first passage may be in communication with a suction pressure region of the compressor. The compressor may further include a valve assembly in communication with the second passage and selectively providing a pressurized fluid to the second passage to bias the first piston toward the second end plate. The valve assembly may selectively provide communication between the second passage and the suction pressure region to provide displacement of the first piston to the second position.

The first recess may be in the form of an annular recess and the first piston may be in the form of an annular piston. The first passage may extend radially through the structure and into the first recess. The second passage may extend radially through the structure and into the first recess. The first scroll member may be supported for axial displacement relative to the second scroll member.

The first passage may be in communication with a vapor source forming a vapor injection system. The compressor may further include an actuation mechanism in communication with the second passage, a first pressure source, and a second pressure source to selectively displace the first piston between the first and second positions. The first pressure source may include a discharge pressure and the second pressure source may include suction pressure. The compressor may additionally include a second piston. The structure may include a second recess housing the second piston, a third passage in communication with the second recess and the vapor source, and a fourth passage in communication with the actuation mechanism. The second recess may be generally aligned with a second aperture extending through the second end plate of the second scroll member and in communication with a second of the compression pockets.

The second scroll member may form an orbiting scroll. The compressor may additionally include a seal engaged with the first scroll member. The first scroll member may include a second aperture extending through the first end plate and being in communication with an axial biasing chamber defined by the first scroll member and the seal. The second aperture may be in communication with a second of the compression pockets located radially inward relative to the first compression pocket.

In another arrangement, a compressor may include a non-orbiting scroll member, an orbiting scroll member, a structure supporting the orbiting scroll member for orbital movement relative to the non-orbiting scroll member, and a piston. The non-orbiting scroll member may include a first end plate and a first spiral wrap extending from the first end plate. The orbiting scroll member may include a second end plate and a second spiral wrap extending from the second end plate and engaged with the first spiral wrap to form compression pockets. The second end plate may include a first aperture extending therethrough and in communication with a first of the compression pockets. The structure may include a recess generally aligned with the aperture, a first passage in communication with a suction pressure region of the compressor and the recess, and a second passage in communication with the recess. The piston may be located within the recess and may be axially displaceable between first and second positions. The piston may isolate the first passage from communication with the second passage when in the first and second positions. The piston may provide communication between the aperture and the first passage when in the first position. The piston may provide communication between the first aperture and the suction pressure region when in the second position.

The compressor may additionally include a valve assembly in communication with the second passage to selectively provide a pressurized fluid to the second passage to bias the piston toward the second end plate. The valve assembly may selectively provide communication between the second passage and the suction pressure region to provide displacement of the piston to the second position. The recess may form an annular recess and the piston may form an annular piston.

In another arrangement, a compressor may include a non-orbiting scroll member, an orbiting scroll member, a structure supporting the orbiting scroll member for orbital movement relative to the non-orbiting scroll member, an actuation mechanism, and a first piston. The non-orbiting scroll member may include a first end plate and a first spiral wrap extending from the first end plate. The orbiting scroll member may include a second end plate and a second spiral wrap extending from the second end plate and engaged with the first spiral wrap to form compression pockets. The second end plate may include a first aperture extending therethrough and in communication with the first of the compression pockets. The structure may include a first recess generally aligned with the first aperture, a first passage in communication with the first recess, and a second passage in communication with the first recess at a vapor source. The actuation mechanism may be in communication with the first passage and first and second pressure sources. The first piston may be located within the first recess and may be axially displaceable between first and second positions by the actuation mechanism. The first piston may isolate the first passage from communication with the second passage when in the first and second positions. The first piston may provide communication between the first aperture and the vapor source when in the first position. The first piston may provide communication between the first aperture and the vapor source may in the second position.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
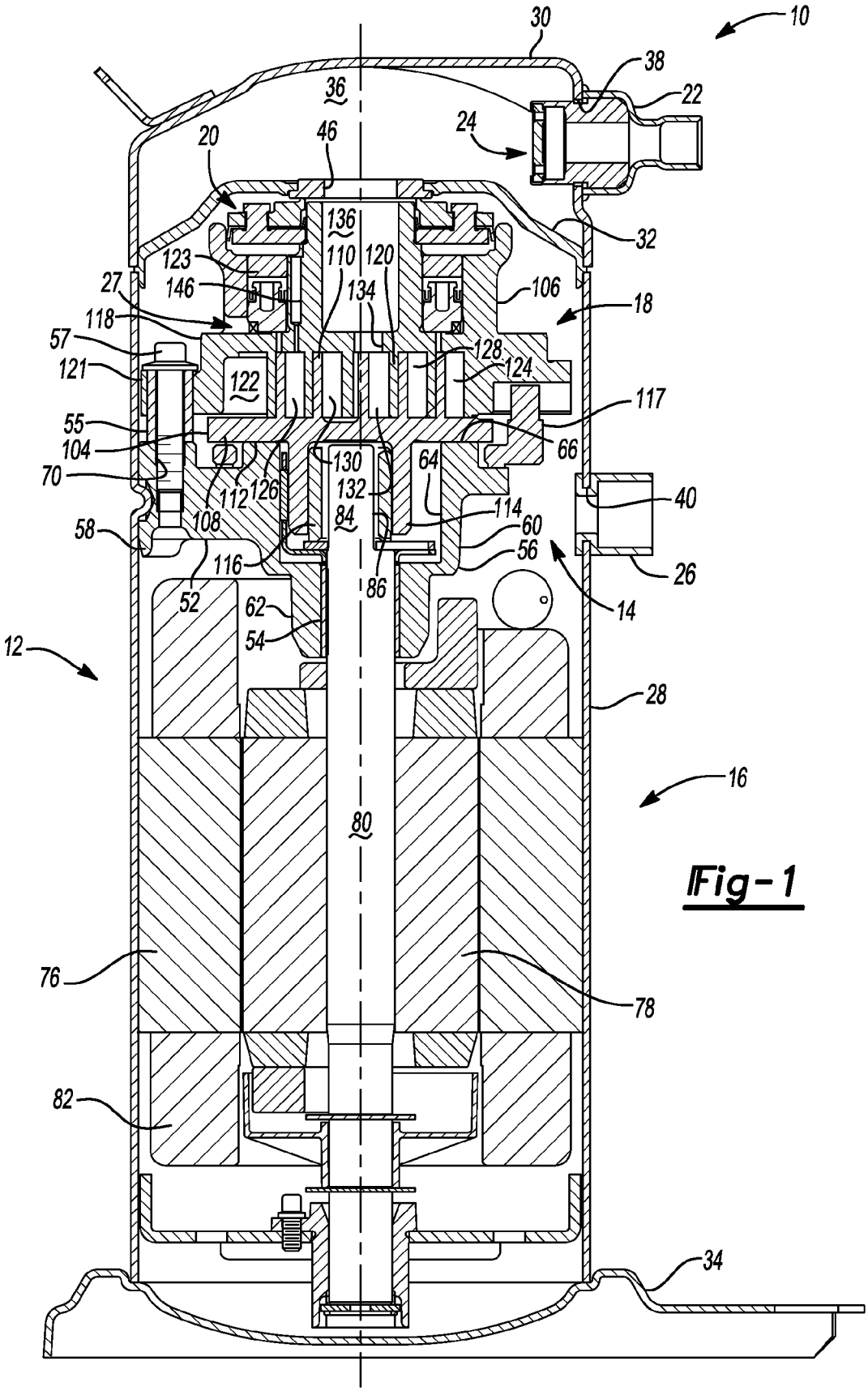
FIG. 1 is a section view of a compressor according to the present disclosure.

The following description is merely exemplary in nature and is not intended to limit the present disclosure, application, or uses. It should be understood that throughout the drawings, corresponding reference numerals indicate like or corresponding parts and features.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 may include a hermetic shell assembly 12, a main bearing housing assembly 14, a motor assembly 16, a compression mechanism 18, a seal assembly 20, a refrigerant discharge fitting 22, a discharge valve assembly 24, a suction gas inlet fitting 26, and a modulation assembly 27. Shell assembly 12 may house main bearing housing assembly 14, motor assembly 16, and compression mechanism 18.

Shell assembly 12 may generally form a compressor housing and may include a cylindrical shell 28, an end cap 30 at the upper end thereof, a transversely extending partition 32, and a base 34 at a lower end thereof. End cap 30 and partition 32 may generally define a discharge chamber 36. Discharge chamber 36 may generally form a discharge muffler for compressor 10. Refrigerant discharge fitting 22 may be attached to shell assembly 12 at opening 38 in end cap 30. Discharge valve assembly 24 may be located within discharge fitting 22 and may generally prevent a reverse flow condition. Suction gas inlet fitting 26 may be attached to shell assembly 12 at opening 40. Partition 32 may include a discharge passage 46 therethrough providing communication between compression mechanism 18 and discharge chamber 36.

Main bearing housing assembly 14 may be affixed to shell 28 at a plurality of points in any desirable manner, such as staking. Main bearing housing assembly 14 may include a main bearing housing 52, a first bearing 54 disposed therein, bushings 55, and fasteners 57. Main bearing housing 52 may include a central body portion 56 having a series of arms 58 extending radially outwardly therefrom. Central body portion 56 may include first and second portions 60, 62 having an opening 64 extending therethrough. Second portion 62 may house first bearing 54 therein. First portion 60 may define an annular flat thrust bearing surface 66 on an axial end surface thereof. Arm 58 may include apertures 70 extending therethrough and receiving fasteners 57.

Motor assembly 16 may generally include a motor stator 76, a rotor 78, and a drive shaft 80. Windings 82 may pass through stator 76. Motor stator 76 may be press fit into shell 28. Drive shaft 80 may be rotatably driven by rotor 78. Rotor 78 may be press fit on drive shaft 80. Drive shaft 80 may include an eccentric crank pin 84 having a flat 86 thereon.

Compression mechanism 18 may generally include an orbiting scroll 104 and a non-orbiting scroll 106. Orbiting scroll 104 may include an end plate 108 having a spiral vane or wrap 110 on the upper surface thereof and an annular flat thrust surface 112 on the lower surface. Thrust surface 112 may interface with annular flat thrust bearing surface 66 on main bearing housing 52. A cylindrical hub 114 may project downwardly from thrust surface 112 and may have a drive bushing 116 rotatively disposed therein. Drive bushing 116 may include an inner bore in which crank pin 84 is drivingly disposed. Crank pin flat 86 may drivingly engage a flat surface in a portion of the inner bore of drive bushing 116 to provide a radially compliant driving arrangement. An Oldham coupling 117 may be engaged with the orbiting and non-orbiting scrolls 104, 106 to prevent relative rotation therebetween.

Figure 2:
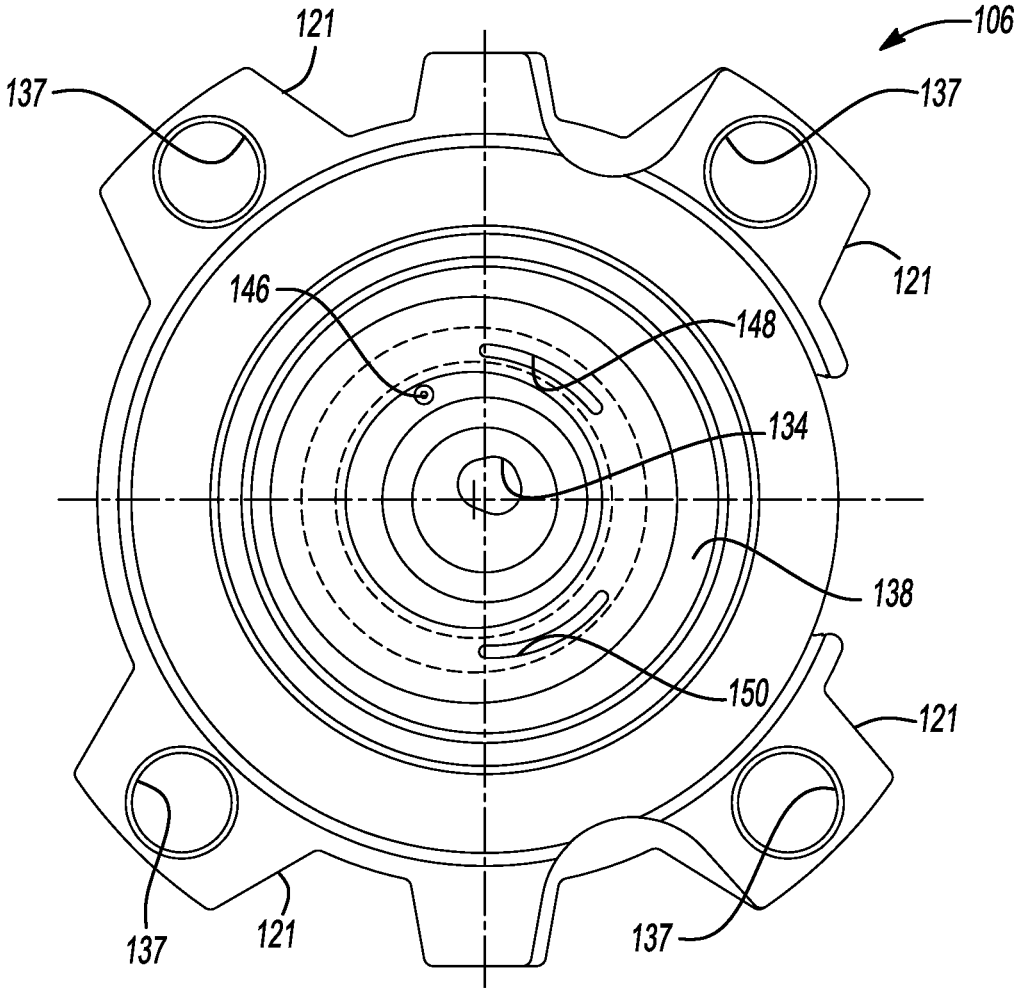
FIG. 2 is a plan view of a non-orbiting scroll member of the compressor of FIG. 1.
Figure 3:
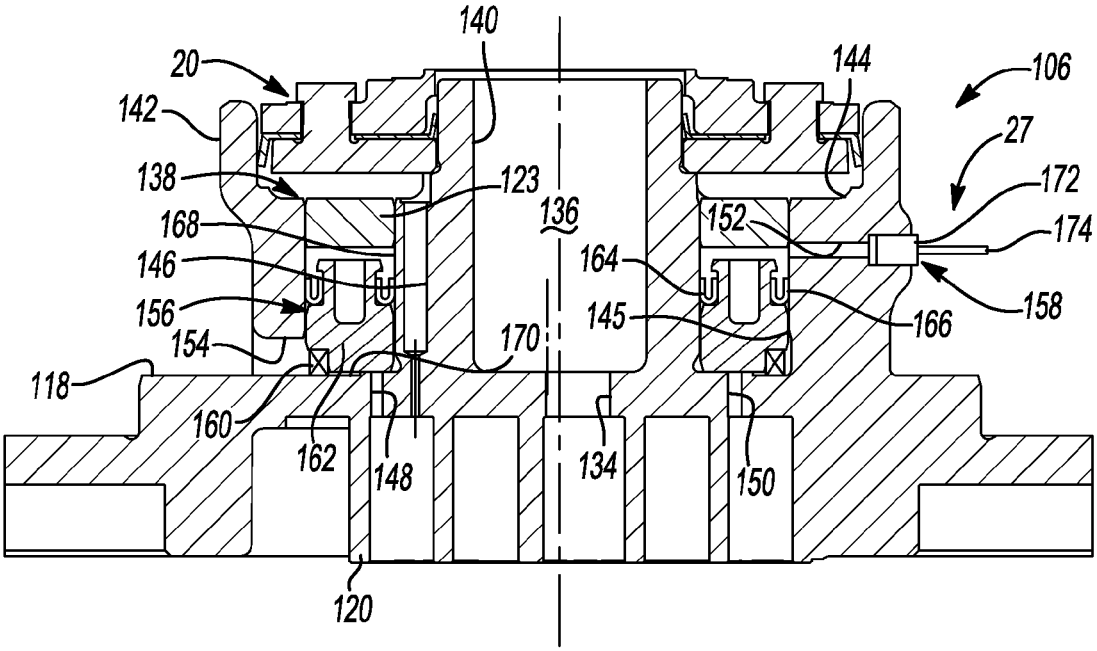
FIG. 3 is a section view of a non-orbiting scroll, seal assembly, and modulation system of the compressor of FIG. 1.
Figure 4:
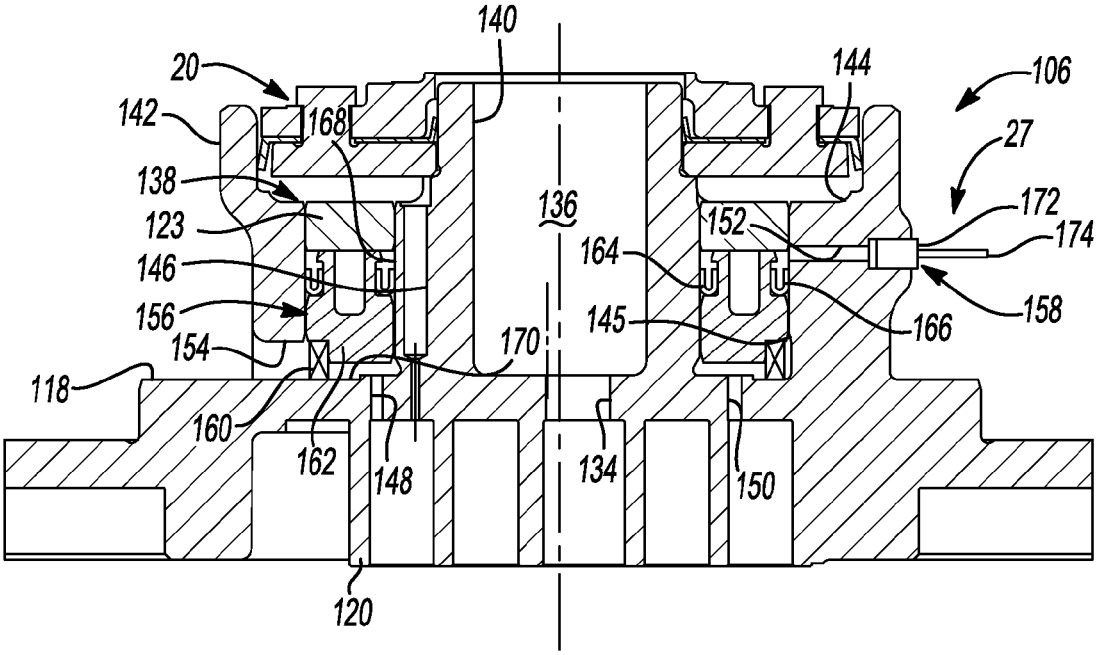
FIG. 4 is an additional section view of the non-orbiting scroll, seal assembly, and modulation system of FIG. 3.

With additional reference to FIGS. 2-4, non-orbiting scroll 106 may include an end plate 118 having a spiral wrap 120 on a lower surface thereof, a series of radially outwardly extending flanged portions 121, and an annular ring 123. Spiral wrap 120 may form a meshing engagement with wrap 110 of orbiting scroll 104, thereby creating an inlet pocket 122, intermediate pockets 124, 126, 128, 130, and an outlet pocket 132. Non-orbiting scroll 106 may be axially displaceable relative to main bearing housing assembly 14, shell assembly 12, and orbiting scroll 104. Non-orbiting scroll 106 may include a discharge passage 134 in communication with outlet pocket 132 and upwardly open recess 136 which may be in fluid communication with discharge chamber 36 via discharge passage 46 in partition 32.

Flanged portions 121 may include openings 137 therethrough. Opening 137 may receive bushings 55 therein and bushings 55 may receive fasteners 57. Fasteners 57 may be engaged with main bearing housing 52 and bushings 55 may generally form a guide for axial displacement of non-orbiting scroll 106. Fasteners 57 may additionally prevent rotation of non-orbiting scroll 106 relative to main bearing housing assembly 14.

Non-orbiting scroll 106 may include an annular recess 138 in the upper surface thereof defined by parallel coaxial inner and outer side walls 140, 142. Annular ring 123 may be disposed within annular recess 138 and may separate annular recess 138 into first and second annular recesses 144, 145. First and second annular recesses 144, 145 may be isolated from one another. First annular recess 144 may provide for axial biasing of non-orbiting scroll 106 relative to orbiting scroll 104, as discussed below. More specifically, a passage 146 may extend through end plate 118 of non-orbiting scroll 106, placing first annular recess 144 in fluid communication with one of intermediate pockets 124, 126, 128, 130. While passage 146 is shown extending into intermediate pocket 126, it is understood that passage 146 may alternatively be placed in communication with any of the other intermediate pockets 124, 128, 130.

Additional passages 148, 150 may extend through end plate 118, placing second annular recess 145 in communication with two of intermediate fluid pockets 124, 128, 130. Second annular recess 145 may be in communication with different ones of intermediate fluid pockets 124, 126, 128, 130 than first annular recess 144. More specifically, second annular recess 145 may be in communication with intermediate fluid pockets 124, 126, 128, 130 located radially outwardly relative to the intermediate fluid pocket 124, 126, 128, 130 in communication with the first annular recess 144. Therefore, first annular recess 144 may operate at a pressure greater than an operating pressure of second annular recess 145. First and second radial passages 152, 154 may extend into second annular recess 145 and may cooperate with modulation assembly 27 as discussed below.

Seal assembly 20 may include a floating seal located within first annular recess 144. Seal assembly 20 may be axially displaceable relative to shell assembly 12 and non-orbiting scroll 106 to provide for axial displacement of non-orbiting scroll 106 while maintaining a sealed engagement with partition 32 to isolate discharge and suction pressure regions of compressor 10 from one another. More specifically, pressure within first annular recess 144 may urge seal assembly 20 into engagement with partition 32 during normal compressor operation.

Modulation assembly 27 may include a piston assembly 156, a valve assembly 158, and a biasing member 160. The piston assembly 156 may include an annular piston 162 and first and second annular seals 164, 166. Annular piston 162 may be located in second annular recess 145 and first and second annular seals 164, 166 may be engaged with inner and outer side walls 140, 142 to separate second annular recess 145 into first and second portions 168, 170 that are isolated from one another. First portion 168 may be in communication with first radial passage 152 and second portion 170 may be in communication with second radial passage 154. Valve assembly 158 may include a valve member 172 in communication with a pressure source 174 and with first radial passage 152, and therefore first portion 168. Biasing member 160 may include a spring and may be located in second portion 170 and engaged with annular piston 162.

Annular piston 162 may be displaceable between first and second positions. In the first position (FIG. 3), annular piston 162 may seal passages 148, 150 from communication with second portion 170 of second annular recess 145. In the second position (FIG. 4), annular piston 162 may be displaced from passages 148, 150, providing communication between passages 148, 150 and second portion 170 of second annular recess 145. Therefore, when annular piston 162 is in the second position, passages 148, 150 may be in communication with a suction pressure region of compressor 10 via second radial passage 154 providing a reduced capacity operating mode for compressor 10.

Pressure source 174 may include a pressure that is greater than an operating pressure of intermediate pockets 124, 126, 128, 130. Valve member 172 may provide communication between pressure source 174 and first portion 168 of second annular recess 145 to displace annular piston 162 to the first position. Valve member 172 may prevent communication between pressure source 174 and first portion 168 of second annular recess 145 to displace annular piston 162 to the second position. Valve member 172 may additionally vent first portion 168 to the suction pressure region of compressor 10 to displace annular piston 162 to the second position. Biasing member 160 may generally bias annular piston 162 toward the second position.

Figure 5:
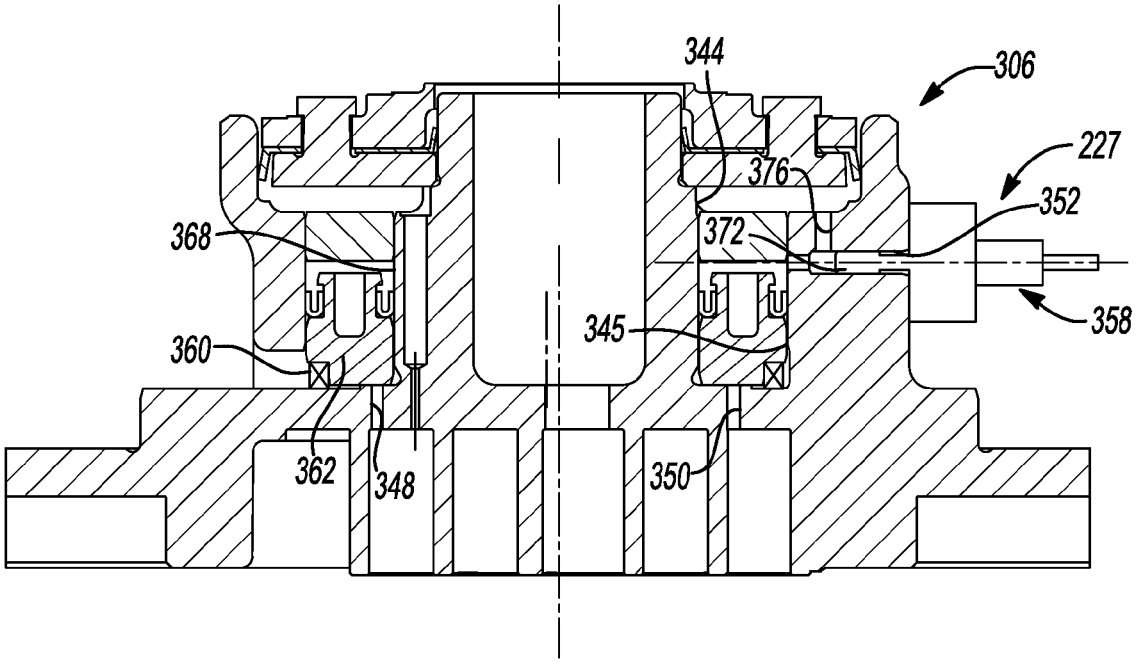
FIG. 5 is a section view of an alternate non-orbiting scroll, seal assembly, and modulation system according to the present disclosure.
Figure 6:
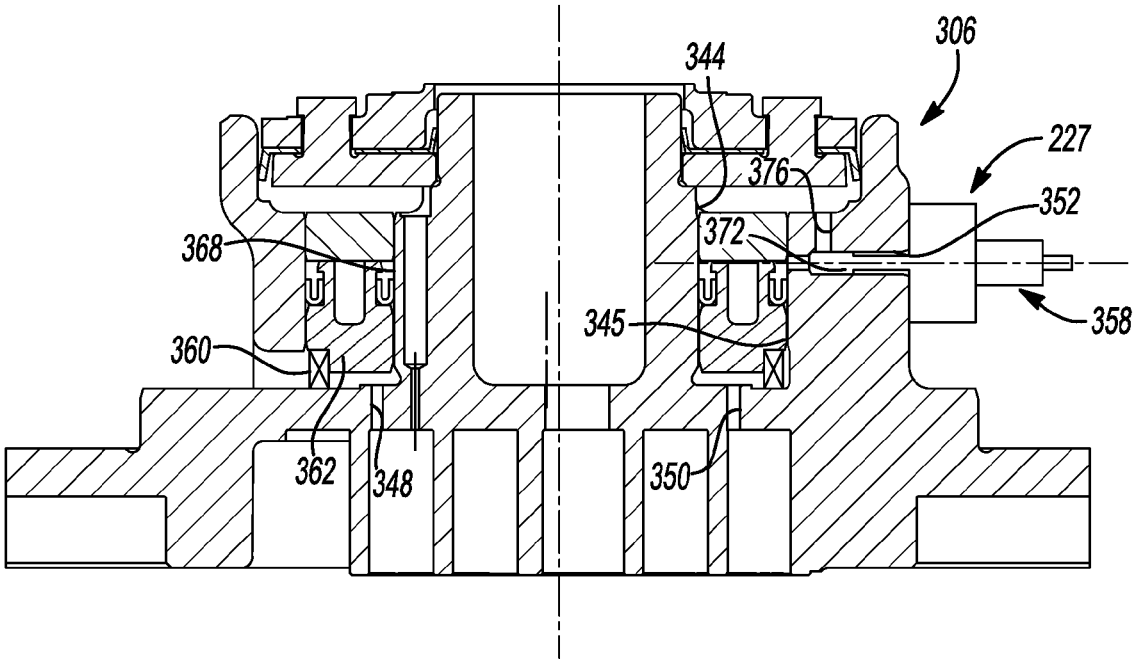
FIG. 6 is an additional section view of the non-orbiting scroll, seal assembly, and modulation system of FIG. 5.

With reference to FIGS. 5 and 6, an alternate non-orbiting scroll 306 and modulation assembly 227 are shown. Non-orbiting scroll 306 may be generally similar to non-orbiting scroll 106. Therefore, it is understood that the description of non-orbiting scroll 106 applies equally to non-orbiting scroll 306 with the exceptions indicated below. Further, it is understood that non-orbiting scroll 306 and modulation assembly 227 may be incorporated into a compressor such as compressor 10 in place of non-orbiting scroll 106 and modulation assembly 27.

Non-orbiting scroll 306 may include a passage 376 extending between and providing communication between first annular recess 344 and first portion 368 of second annular recess 345. Modulation assembly 227 may include a valve assembly 358 having a valve member 372 located in radial passage 352. Valve member 372 may be displaceable between first and second positions to displace annular piston 362 between first and second positions. The first and second positions of annular piston 362 and corresponding capacity reduction may be generally similar to that discussed above for modulation assembly 27. Therefore, for simplicity, the description will not be repeated with the understanding that the above description applies equally to the modulation assembly 227.

Valve member 372 may provide communication between the first and second annular recesses 344, 345 when valve member 372 is in the first position (FIG. 5). Since first annular recess 344 operates at a higher pressure than second annular recess 345, annular piston 362 may be displaced (or held) in the first position. Valve member 372 may be displaced to the second position and vent first portion 368 of second annular recess 345 to suction pressure in order to displace annual piston 362 to the second position (FIG. 6). In the second position, valve member 372 may seal passage 376 to isolate first and second annular recesses 344, 345 from one another. When first and second annular recesses 344, 345 are isolated from one another, biasing member 360 may urge annular piston 362 to the second position where passages 348, 350 are in communication with a suction pressure region.

Figure 7:
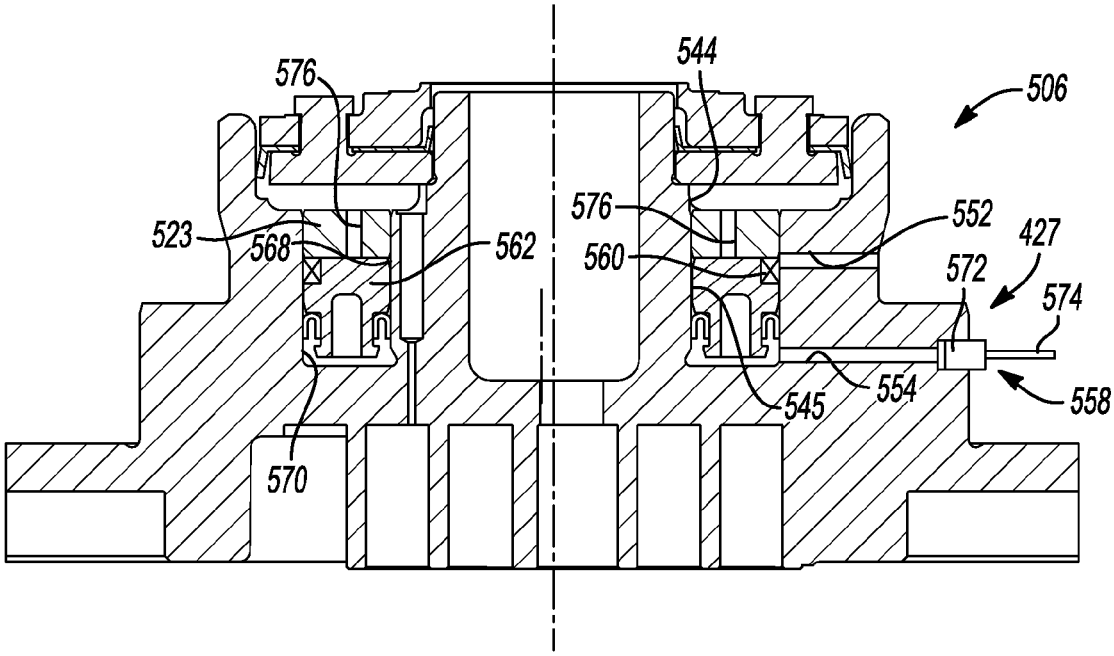
FIG. 7 is a section view of an alternate non-orbiting scroll, seal assembly, and modulation system according to the present disclosure.
Figure 8:
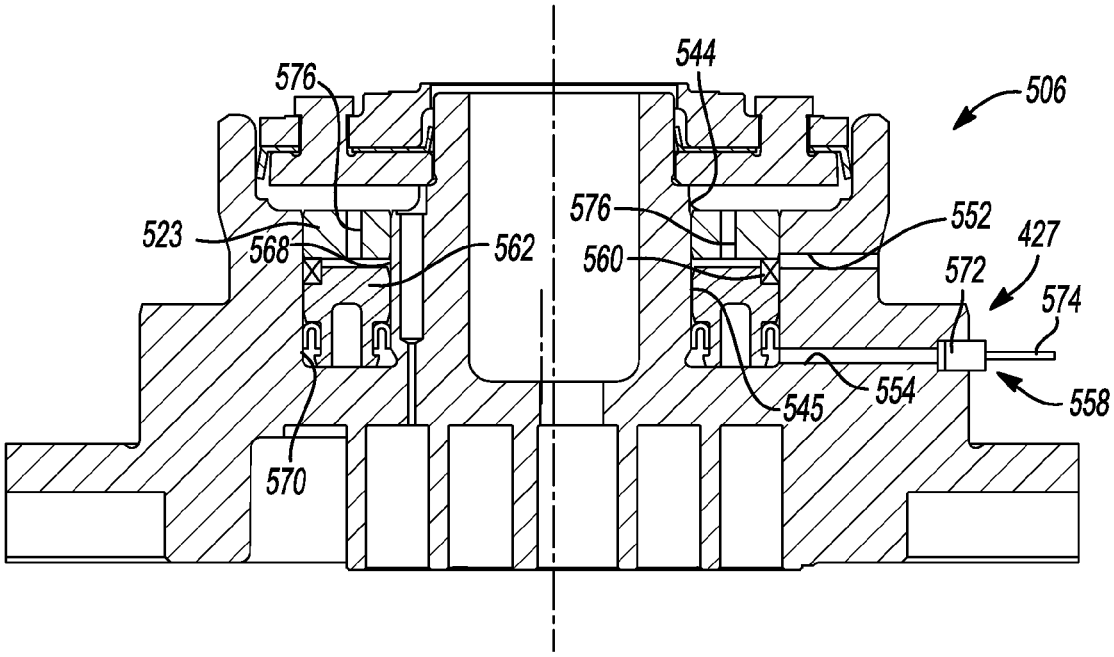
FIG. 8 is an additional section view of the non-orbiting scroll, seal assembly, and modulation system of FIG. 7.

With reference to FIGS. 7 and 8, an alternate non-orbiting scroll 506 and modulation assembly 427 are shown. Non-orbiting scroll 506 may be generally similar to non-orbiting scroll 106. Therefore, it is understood that the description of non-orbiting scroll 106 applies equally to non-orbiting scroll 506 with the exceptions indicated below. Further, it is understood that non-orbiting scroll 506 and modulation assembly 427 may be incorporated into a compressor such as compressor 10 in place of non-orbiting scroll 106 and modulation assembly 27.

Non-orbiting scroll 506 may include passages 576 extending through annular ring 523 and providing communication between first annular recess 544 and first portion 568 of second annular recess 545. Second portion 570 of second annular recess 545 may be isolated from intermediate pockets. Radial passage 552 may be in communication with a suction pressure region and radial passage 554 may be in communication with modulation assembly 427. Modulation assembly 427 may be generally similar to modulation assembly 27. Therefore, it is understood that the description of modulation assembly 27 applies to modulation assembly 427 with the exceptions noted below.

Modulation assembly 427 may include a valve assembly 558 including a valve member 572 in communication with radial passage 554, a pressure source 574 and the suction pressure region. Pressure source 574 may include a pressure that is greater than an operating pressure within first annular recess 544. Valve member 572 may provide communication between pressure source 574 and second portion 570 of second annular recess 545 to bias annular piston 562 into a first position (FIG. 7). Annular piston 562 may seal passage 576 when in the first position to prevent fluid communication between first annular recess 544 and the first portion 568 of second annular recess 545 when in the first position.

Valve member 572 may vent second portion 570 of second annular recess 545 to a suction pressure region and biasing member 560 may act on annular piston 562 to displace annular piston 562 to a second position (FIG. 8). Annular piston 562 may be displaced from passage 576 when in the second position. Passage 576 may therefore provide communication between first annular recess 544 and a suction pressure region when annular piston 562 is in the second position. Providing communication between the first annular recess 544 and the suction pressure region may remove the axial biasing force that normally urges non-orbiting scroll 506 toward an orbiting scroll (not shown) providing a reduced compressor operating capacity by providing clearance between the non-orbiting scroll end plate and the orbiting scroll wrap, as well as the non-orbiting scroll wrap and the orbiting scroll end plate. The capacity is reduced to zero when the axial biasing force is removed and the axial clearance exists between the orbiting and non-orbiting scrolls. In order to modulate the compressor to a desired capacity between about 0% to 100%, the piston may be actuated in a pulse width modulation manner to achieve a desired capacity. The scrolls will switch between a generally sealed state and an un-sealed state to provide a desired output capacity.

Figure 9:
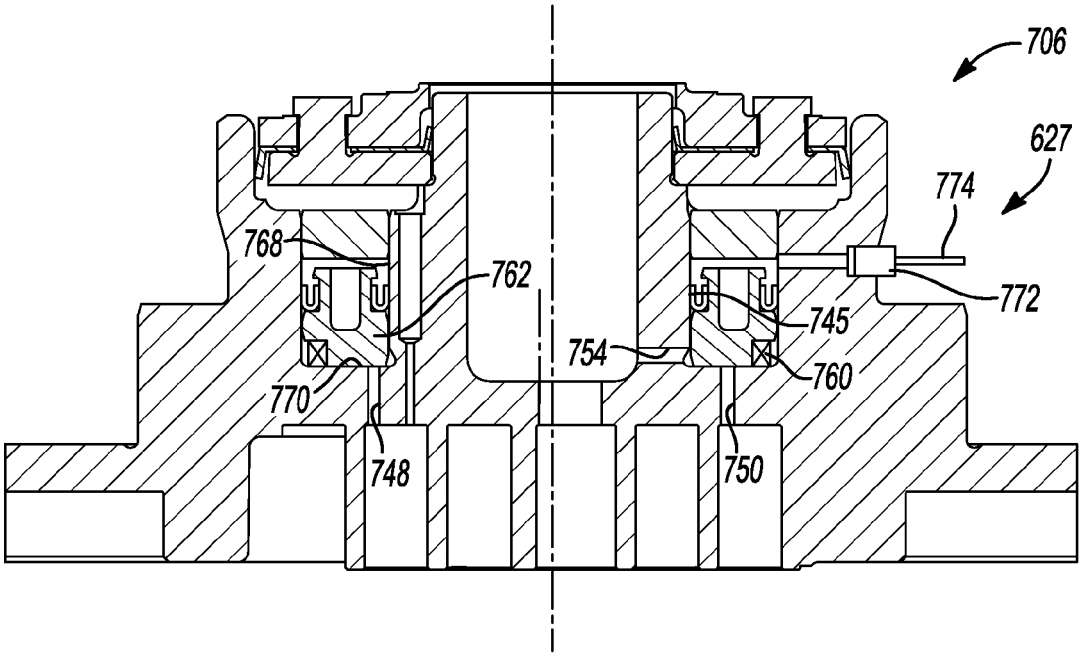
FIG. 9 is a section view of an alternate non-orbiting scroll, seal assembly, and modulation system according to the present disclosure.
Figure 10:
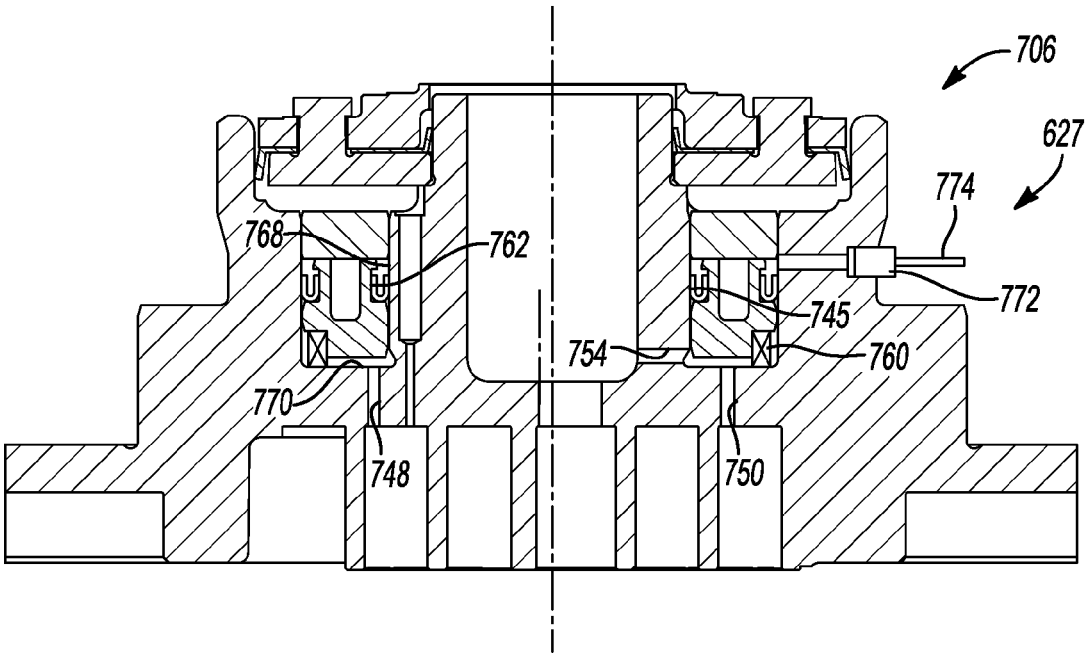
FIG. 10 is an additional section view of the non-orbiting scroll, seal assembly, and modulation system of FIG. 9.

With reference to FIGS. 9 and 10, an alternate non-orbiting scroll 706 and modulation assembly 627 are shown. Non-orbiting scroll 706 may be generally similar to non-orbiting scroll 106. Therefore, it is understood that the description of non-orbiting scroll 106 applies equally to non-orbiting scroll 706 with the exceptions indicated below. Further, it is understood that non-orbiting scroll 706 and modulation assembly 627 may be incorporated into a compressor such as compressor 10 in place of non-orbiting scroll 106 and modulation assembly 27.

Non-orbiting scroll 706 may include a radial passage 754 extending between and in communication with second portion 770 of second annular recess 745 and a discharge pressure region (rather than a suction pressure region shown in FIGS. 3 and 4 for second radial passage 154). Pressure source 774 may include a pressure that is greater than an operating pressure of second portion 770 of second annular recess 745. Valve member 772 may provide communication between pressure source 774 and first portion 768 of second annular recess 745 to displace annular piston 762 to the first position (FIG. 9).

Valve member 772 may prevent communication between pressure source 774 and first portion 768 of second annular recess 745 to displace annular piston 762 to the second position (FIG. 10). Valve member 772 may additionally vent first portion 768 to a suction pressure region to displace annular piston 762 to the second position. Biasing member 760 may generally bias annular piston 762 toward the second position. The second position of annular piston 762 may provide communication between second portion 770 of second annular recess 745, and therefore passages 748, 750, and a discharge pressure region to provide a change in a compression volume ratio for the compressor.

Figure 11:
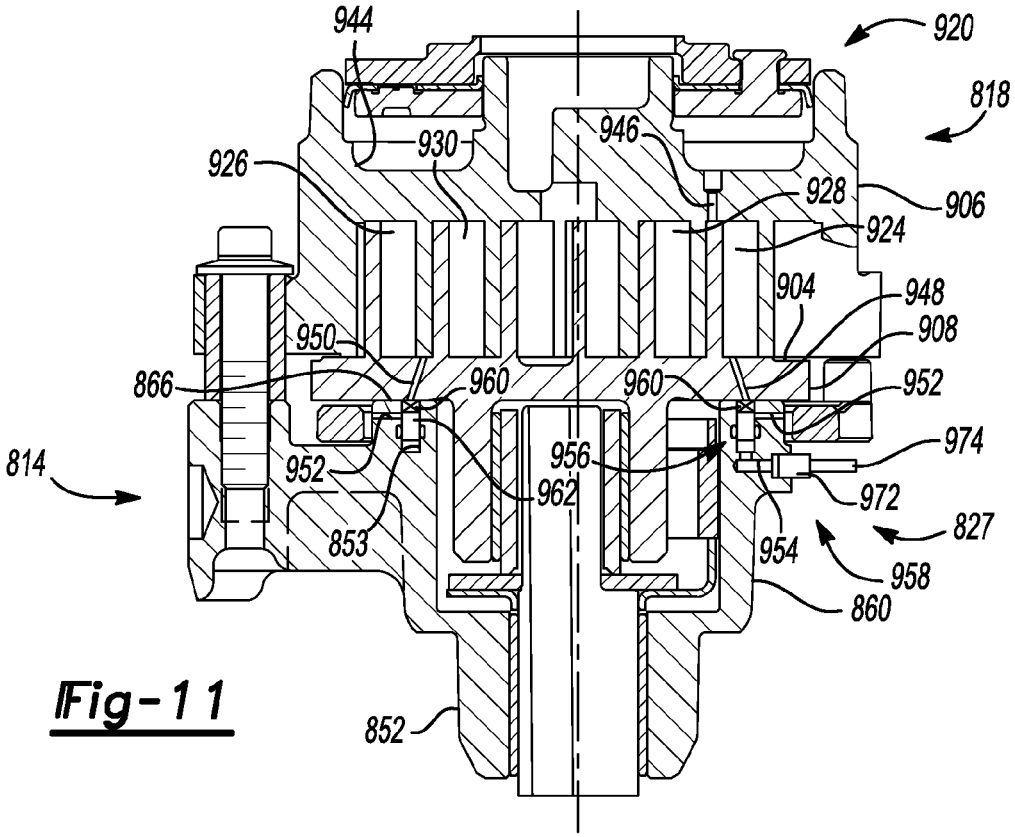
FIG. 11 is a fragmentary section view of an alternate compressor according to the present disclosure.
Figure 12:
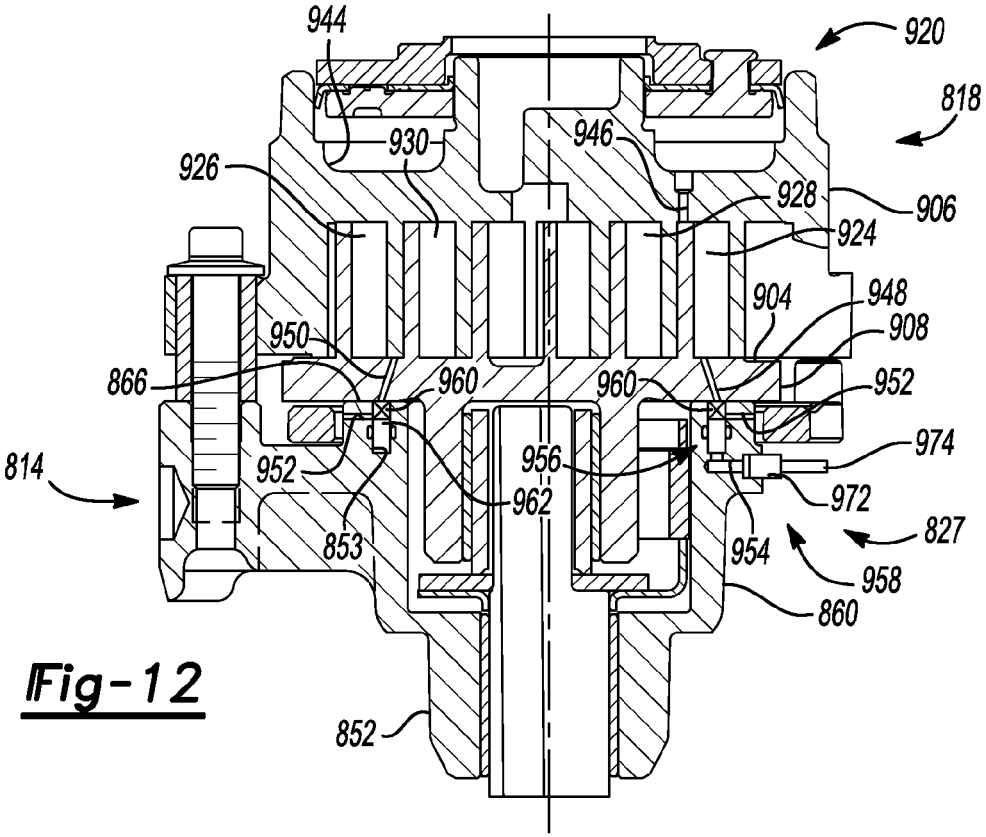
FIG. 12 is an additional fragmentary section view of the compressor of FIG. 11.

With reference to FIGS. 11 and 12, an alternate main bearing housing assembly 814, compression mechanism 818, and a capacity adjustment assembly 827 are illustrated. Capacity adjustment assembly 827 may include a modulation assembly. Main bearing housing assembly 814 and compression mechanism 818 may be generally similar to main bearing housing assembly 14 and compression mechanism 18. Therefore, for simplicity, it is understood that the description of main bearing housing assembly 14 and compression mechanism 18 above applies equally to main bearing housing assembly 814 and compression mechanism 818 with the exceptions indicated below. Further, it is understood that main bearing housing assembly 814, compression mechanism 818, and capacity adjustment assembly 827 may be incorporated into a compressor similar to compressor 10 in place of main bearing housing assembly 14, compression mechanism 18, and modulation assembly 27.

Main bearing housing assembly 814 may include main bearing housing 852. Main bearing housing 852 may include an annular passage 853 that forms an annular recess extending into thrust bearing surface 866. First radial passages 952 may extend radially through first portion 860 and into annular passage 853, providing communication between annular passage 853 and a suction pressure region. A second radial passage 954 may extend radially through first portion 860 and into annular passage 853 and may be in communication with capacity adjustment assembly 827, as discussed below.

Compression mechanism 818 may include orbiting scroll 904 and non-orbiting scroll 906. Orbiting scroll 904 may include first and second passages 948, 950 extending through end plate 908 and providing communication between two of intermediate fluid pockets 924, 926, 928, 930 and annular passage 853. Non-orbiting scroll 906 may include a single annular recess 944 having seal assembly 920 disposed therein. Passage 946 may provide communication between annular recess 944 and one of intermediate fluid pockets 924, 926, 928, 930. The intermediate fluid pocket 924, 926, 928, 930 in communication annular recess 944 may be different than the two of intermediate fluid pockets 924, 926, 928, 930 in communication with annular passage 853. More specifically, the intermediate fluid pocket 924, 926, 928, 930 in communication annular recess 944 may be located radially inwardly relative to and operate at a pressure greater than the two of intermediate fluid pockets 924, 926, 928, 930 in communication with annular passage 853.

Capacity adjustment assembly 827 may include a piston assembly 956, a valve assembly 958, and a biasing member 960. The piston assembly 956 may include an annular piston 962 located in annular passage 853. Annular piston 962 may be displaceable between first and second positions. In the first position (FIG. 11), annular piston 962 may isolate first and second passages 948, 950 from first radial passage 952. In the second position, (FIG. 12), annular piston 962 may be displaced to provide communication between first and second passages 948, 950 and first radial passage 952. In the second position, first and second passages 948, 950 may be in communication with a suction pressure region via first radial passage 952 providing a reduced capacity operating mode. In both the first and second positions, annular piston 962 may isolate first and second radial passages 952, 954 from one another and may additionally isolate first and second passages 948, 950 from second radial passage 954.

Valve assembly 958 may include a valve member 972 in communication with a pressure source 974 and with second radial passage 954. Biasing member 960 may include a spring and may be located in annular passage 853 and engaged with annular piston 962. Valve assembly 958 may displace annular piston 962 between the first and second positions. Valve member 972 may provide communication between pressure source 974 and second radial passage 954 to bias annular piston to the first position. The pressure source may include a pressure that is greater than an operating pressure of intermediate pockets 924, 926, 928, 930. Valve member 972 may prevent communication between pressure source 974 and second radial passage 954 and may vent second radial passage to a suction pressure region to allow annular piston 962 to be displaced to the second position. Biasing member 960 may generally bias annular piston 962 to the second position when second radial passage 954 is vented to suction pressure.

Figure 13:
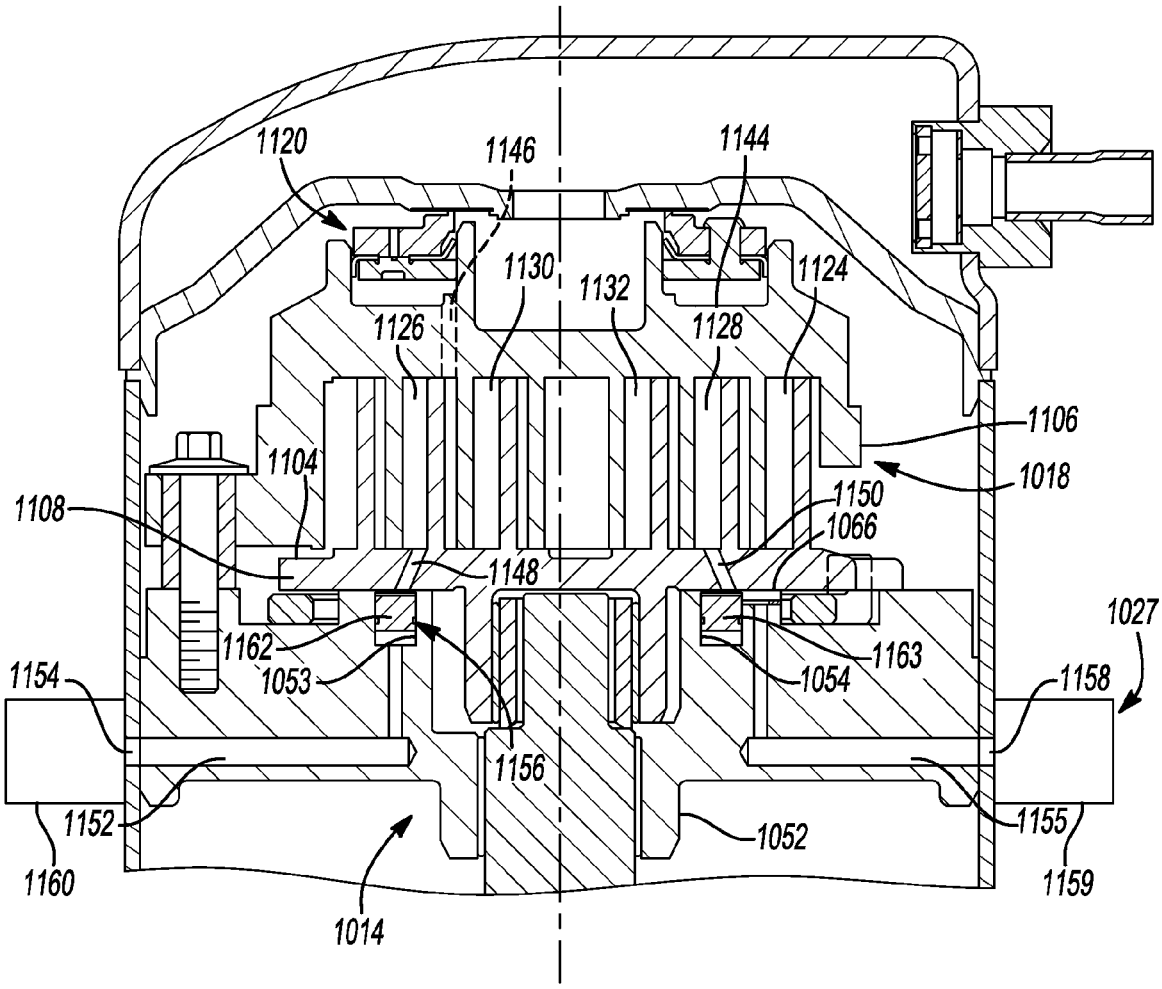
FIG. 13 is a fragmentary section view of an alternate compressor according to the present disclosure.
Figure 14:
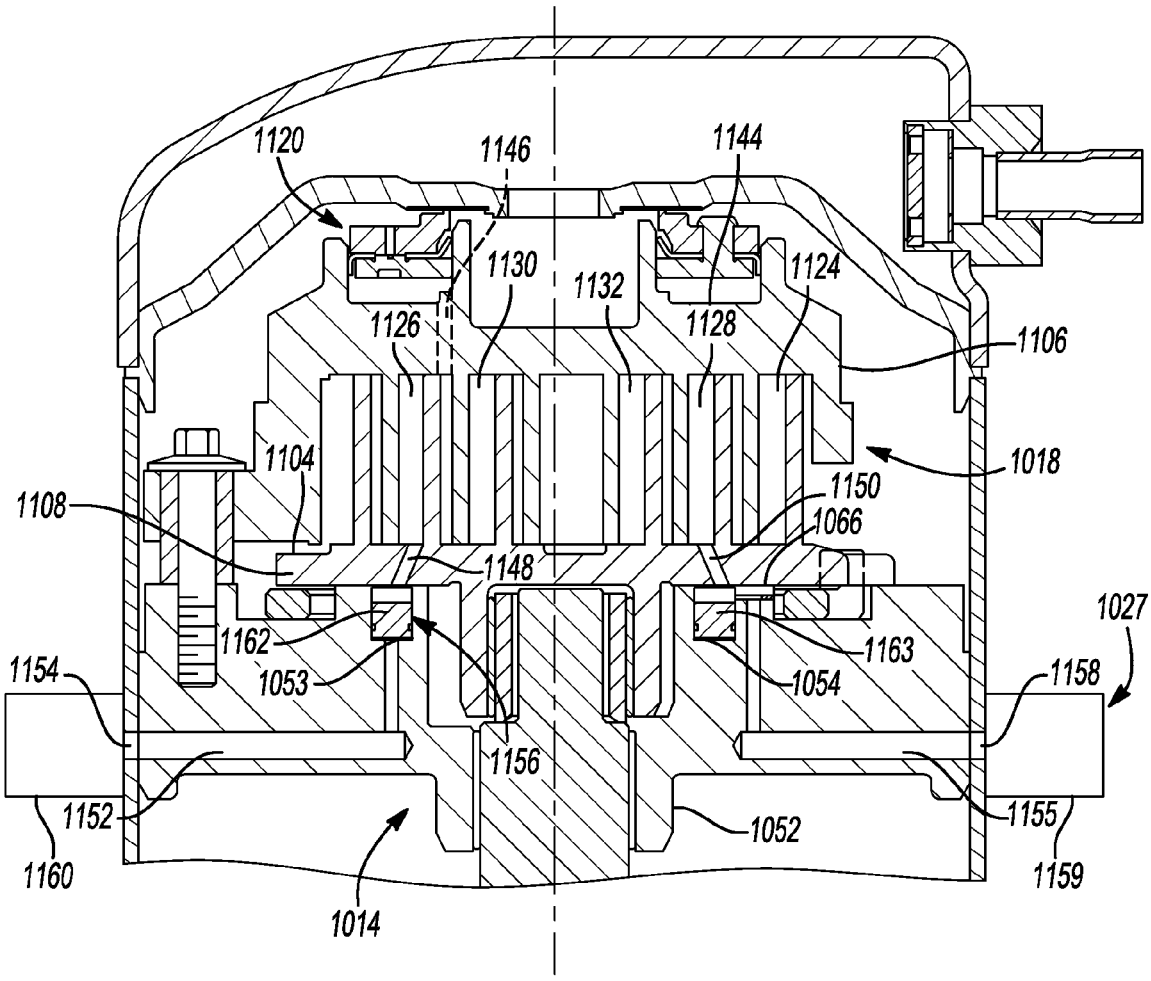
FIG. 14 is an additional fragmentary section view of the compressor of FIG. 13.
Figure 15:
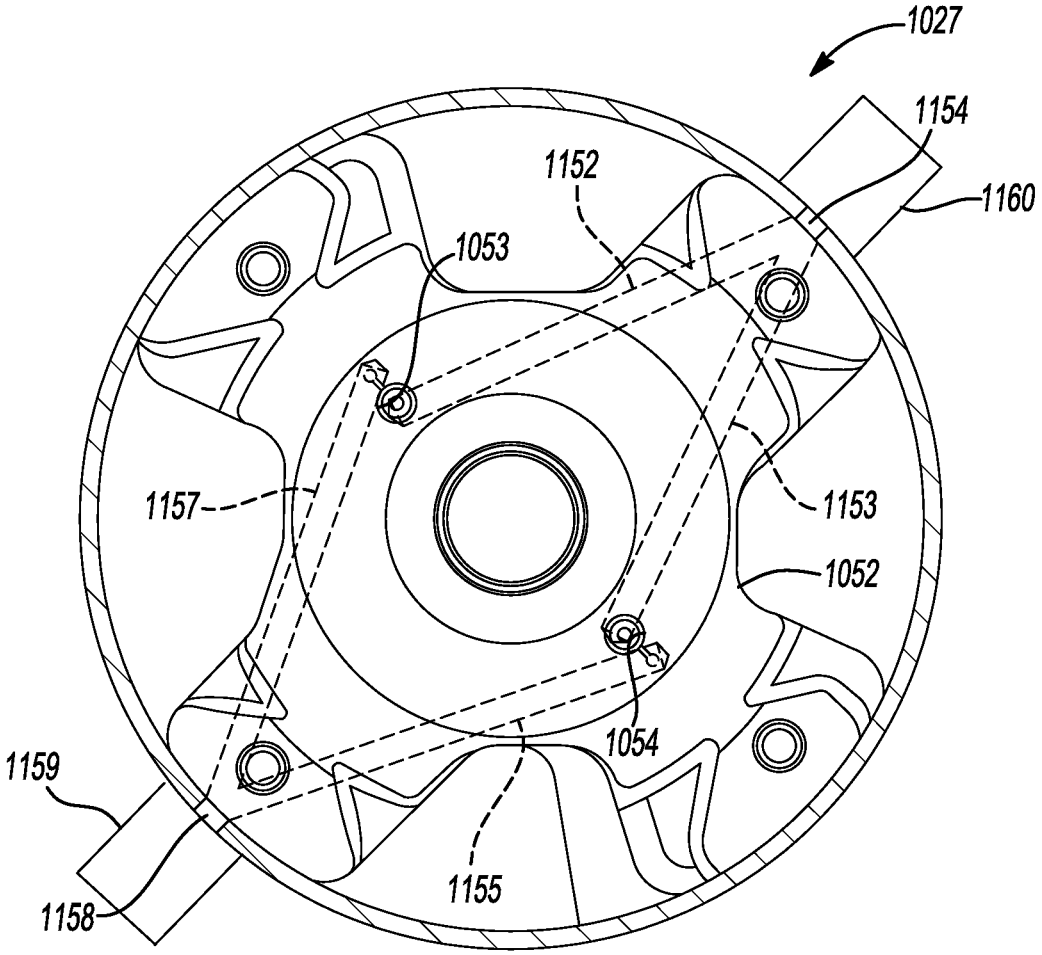
FIG. 15 is a plan view of the main bearing housing of the compressor of FIG. 13.

With reference to FIGS. 13-15, an alternate main bearing housing assembly 1014, compression mechanism 1018 and a capacity adjustment assembly 1027 are illustrated. Capacity adjustment assembly 1027 may include a vapor injection assembly. Main bearing housing assembly 1014 and compression mechanism 1018 may be generally similar to main bearing housing assembly 14 and compression mechanism 18. Therefore, for simplicity, it is understood that the description of main bearing housing assembly 14 and compression mechanism 18 above applies equally to main bearing housing assembly 1014 and compression mechanism 1018 with the exceptions indicated below. Further, it is understood that main bearing housing assembly 1014, compression mechanism 1018, and capacity adjustment assembly 1027 may be incorporated into a compressor similar to compressor 10 in place of main bearing housing assembly 14, compression mechanism 18, and modulation assembly 27.

Main bearing housing assembly 1014 may include main bearing housing 1052. Main bearing housing 1052 may include first and second recesses 1053, 1054 extending axially into thrust bearing surface 1066. A first passage 1152 may extend through main bearing housing 1052 radially inward from an actuation control port 1154 to first recess 1053 and a second passage 1153 may extend through main bearing housing 1052 radially inward from actuation control port 1154 to second recess 1054. A third passage 1155 may extend through main bearing housing 1052 radially inward from an injection port 1158 to first recess 1053 and a fourth passage 1157 may extend through main bearing housing 1052 radially inward from injection port 1158 to second recess 1054.

Compression mechanism 1018 may include orbiting scroll 1104 and non-orbiting scroll 1106. Orbiting scroll 1104 may include first and second passages 1148, 1150 extending through end plate 1108. First passage 1148 may provide communication between one of intermediate fluid pockets 1124, 1126, 1128, 1130, 1132 and first recess 1053. Second passage 1150 may provide communication between another one of intermediate fluid pockets 1124, 1126, 1128, 1130, 1132 and second recess 1054. Non-orbiting scroll 1106 may include a single annular recess 1144 having seal assembly 1120 disposed therein. Passage 1146 may provide communication between annular recess 1144 and one of intermediate fluid pockets 1124, 1126, 1128, 1130, 1132.

The intermediate fluid pocket 1124, 1126, 1128, 1130, 1132 in communication annular recess 1144 may be different than the two of intermediate fluid pockets 1124, 1126, 1128, 1130, 1132 in communication with first and second recesses 1053, 1054. More specifically, the intermediate fluid pocket 1124, 1126, 1128, 1130, 1132 in communication annular recess 1144 may be located radially inwardly relative to and operate at a pressure greater than the two of intermediate fluid pockets 1124, 1126, 1128, 1130, 1132 in communication with first and second recesses 1053, 1054.

Capacity adjustment assembly 1027 may include a piston assembly 1156, a vapor source 1159, and an actuation mechanism 1160. The piston assembly 1156 may include first and second pistons 1162, 1163. First piston 1162 may be located in first recess 1053 and second piston 1163 may be located in second recess 1054. Actuation mechanism 1160 may include a valve in communication with first and second pressure sources and actuation control port 1154. The first pressure source may include a fluid operating at a pressure greater than the operating pressure provided by first and second passages 1148, 1150, such as discharge pressure. The second pressure source may include a fluid operating at a pressure less than the operating pressure provided by first and second passages 1148, 1150, such as suction pressure. Actuation mechanism 1160 may selectively displace first and second pistons 1162, 1163 from a first position (FIG. 13) to a second position (FIG. 14).

First piston 1162 may isolate first passage 1148 from communication with actuation control port 1154 and second piston 1163 may isolate second passage 1150 from communication with actuation control port 1154 when in the first and second positions. Additionally, first and second pistons 1162, 1163 may isolate actuation control port 1154 from communication with injection port 1158 when in the first and second positions.

During operation, the first and second pistons 1162, 1163 may be in the first position during normal compressor operation. Normal compressor operation may include a full operating capacity for the compressor. First and second pistons 1162, 1163 may be in the first position (FIG. 13) when actuation mechanism 1160 provides the first pressure source to first and second recesses 1053, 1054 to isolate first and second passages 1148, 1150 from communication with vapor source 1159. When increased capacity is desired, first and second pistons 1162, 1163 may be displaced to the second position (FIG. 14) by placing first and second recesses 1053, 1054 in communication with the second pressure source. In the second position, vapor source 1159 injects vapor into the compression mechanism 1018 via first and second passages 1148, 1150.

The terms "first", "second", etc. are used throughout the description for clarity only and are not intended to limit similar terms in the claims.

What is claimed is:

1. A compressor comprising:

a first scroll member including a first end plate and a first spiral wrap extending from said first end plate;

a second scroll member including a second end plate and a second spiral wrap extending from said second end plate and engaged with said first spiral wrap to form compression pockets, said second end plate including a first aperture extending therethrough and in communication with a first of said compression pockets;

a structure supporting said second scroll member for orbital movement relative to said first scroll member and including a first recess generally aligned with said first aperture, and first and second passages in communication with said first recess, said first passage in communication with a vapor source forming a vapor injection system; and a first piston located within said first recess and axially displaceable between first and second positions, said first piston isolating said first passage from communication with said second passage when in the first and second positions, said first piston preventing communication between said first aperture and said first passage when in the first position, and said first piston providing communication between said first aperture and said first passage when in the second position.

2. The compressor of claim 1, wherein said second passage is in communication with a suction pressure region of the compressor.

3. The compressor of claim 1, further comprising a valve assembly in communication with said second passage and selectively providing a pressurized fluid to said second passage to bias said first piston toward said second end plate.

4. The compressor of claim 3, wherein said valve assembly selectively provides communication between said second passage and said suction pressure region to provide displacement of said first piston to the second position.

5. The compressor of claim 1, wherein said first recess is an annular recess and said first piston is an annular piston.

6. The compressor of claim 1, wherein said first passage extends radially through said structure and into said first recess.

7. The compressor of claim 1, wherein said second passage extends radially through said structure and into said first recess.

8. The compressor of claim 1, wherein said first scroll member is supported for axial displacement relative to said second scroll member.

9. The compressor of claim 1, further comprising an actuation mechanism in communication with said second passage, a first pressure source, and a second pressure source to selectively displace said first piston between the first and second positions.

10. The compressor of claim 9, wherein said first pressure source is discharge pressure and said second pressure source is suction pressure.

11. The compressor of claim 10, further comprising a second piston, said structure including a second recess housing said second piston, a third passage in communication with said second recess and said vapor source, and a fourth passage in communication with said actuation mechanism, said second recess generally aligned with a second aperture extending through said second end plate of said second scroll member and in communication with a second of said compression pockets.

12. The compressor of claim 1, wherein said second scroll member is an orbiting scroll.

13. The compressor of claim 12, further comprising a seal engaged with said first scroll member, said first scroll member including a second aperture extending through said first end plate and being in communication with an axial biasing chamber defined by said first scroll member and said seal.

14. The compressor of claim 13, wherein said second aperture is in communication with a second of said compression pockets located radially inward relative to said first compression pocket.

15. A compressor comprising:

a non-orbiting scroll member including a first end plate and a first spiral wrap extending from said first end plate;

an orbiting scroll member including a second end plate and a second spiral wrap extending from said second end plate and engaged with said first spiral wrap to form compression pockets, said second end plate including a first aperture extending therethrough and in communication with a first of said compression pockets;

a structure supporting said orbiting scroll member for orbital movement relative to said non-orbiting scroll member and including a first recess generally aligned with said first aperture, a first passage in communication with said first recess, and a second passage in communication with said first recess and a vapor source;

an actuation mechanism in communication with said first passage and first and second pressure sources; and a first piston located within said first recess and axially displaceable between first and second positions by said actuation mechanism, said first piston isolating said first passage from communication with said second passage when in the first and second positions, said first piston preventing communication between said first aperture and said vapor source when in the first position, and said first piston providing communication between said first aperture and said vapor source when in the second position.

16. A compressor comprising:

a non-orbiting scroll member including a first end plate and a first spiral wrap extending from said first end plate, said non-orbiting scroll member including a first aperture extending through said first end plate;

an orbiting scroll member including a second end plate and a second spiral wrap extending from said second end plate and engaged with said first spiral wrap to form compression pockets, said second end plate including a second aperture extending therethrough and in communication with a first of said compression pockets;

a structure supporting said orbiting scroll member for orbital movement relative to said non-orbiting scroll member and including a first recess generally aligned with said second aperture, and first and second passages in communication with said first recess;

a first piston located within said first recess and axially displaceable between first and second positions, said first piston isolating said first passage from communication with said second passage when in the first and second positions, said first piston preventing communication between said second aperture and said first passage when in the first position, and said first piston providing communication between said second aperture and said first passage when in the second position; and a seal engaged with said non-orbiting scroll member and defining an axial biasing chamber between said seal and said non-orbiting scroll member, said first aperture in communication with said axial biasing chamber and with a second of said compression pockets located radially inward relative to said first compression pocket.

17. The compressor of claim 16, further comprising a valve assembly in communication with said second passage and selectively providing a pressurized fluid to said second passage to bias said first piston toward said second end plate.

18. The compressor of claim 17, wherein said valve assembly selectively provides communication between said second passage and said suction pressure region to provide displacement of said first piston to the second position.

19. The compressor of claim 16, wherein said first passage extends radially through said structure and into said first recess.

20. The compressor of claim 16, wherein said second passage extends radially through said structure and into said first recess.

21. The compressor of claim 16, wherein said non-orbiting scroll member is supported for axial displacement relative to said orbiting scroll member.

* * * * *